US010779566B2

(12) United States Patent
Besso et al.

(10) Patent No.: US 10,779,566 B2
(45) Date of Patent: Sep. 22, 2020

(54) SMOKING ARTICLE WITH CONTOURED FILTER PORTION

(71) Applicant: Philip Morris Products, S.A., Neuchatel (CH)

(72) Inventors: Clement Besso, Neuchatel (CH); Dorothy Tritz, Yverdon-les-Bains (CH); Charles Kuersteiner, Jouxtens-Mezery (CH); Alexandre Camus, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 639 days.

(21) Appl. No.: 14/428,486

(22) PCT Filed: Sep. 18, 2013

(86) PCT No.: PCT/IB2013/058647
§ 371 (c)(1),
(2) Date: Mar. 16, 2015

(87) PCT Pub. No.: WO2014/049495
PCT Pub. Date: Apr. 3, 2014

(65) Prior Publication Data

US 2015/0272206 A1 Oct. 1, 2015

Related U.S. Application Data

(60) Provisional application No. 61/706,943, filed on Sep. 28, 2012.

(30) Foreign Application Priority Data

Sep. 28, 2012 (EP) ..... 12186560

(51) Int. Cl.
*A24D 3/04* (2006.01)
*A24C 5/47* (2006.01)
*A24D 1/04* (2006.01)

(52) U.S. Cl.
CPC ..... *A24D 3/04* (2013.01); *A24C 5/47* (2013.01); *A24D 1/04* (2013.01)

(58) Field of Classification Search
CPC ..... A24D 3/04; A24D 3/041; A24D 3/043; A24D 3/045; A24D 3/046; A24D 3/048; A24D 3/0279
See application file for complete search history.

(56) References Cited

U.S. PATENT DOCUMENTS 3,062,218 A 11/1962 Temkovits
3,164,157 A * 1/1965 Lebert ..... A24D 3/045 131/201

(Continued)

FOREIGN PATENT DOCUMENTS

CN 2852724 Y 1/2007
DE 12 49 139 B 8/1967

(Continued)

OTHER PUBLICATIONS

International Preliminary Report on Patentability from PCT/IB2013/058647, dated Apr. 9, 2015, from the International Bureau of WIPO; 7 pgs.

(Continued)

*Primary Examiner* — Michael H. Wilson
*Assistant Examiner* — Yana B Krinker
(74) *Attorney, Agent, or Firm* — Mueting Raasch Group

(57) ABSTRACT

A smoking article includes a contoured filter element having a cylindrical rod end portion and a cylindrical mouth end portion and a contoured portion between the cylindrical rod end portion and the cylindrical mouth end portion. The (Continued)

Figure 1:
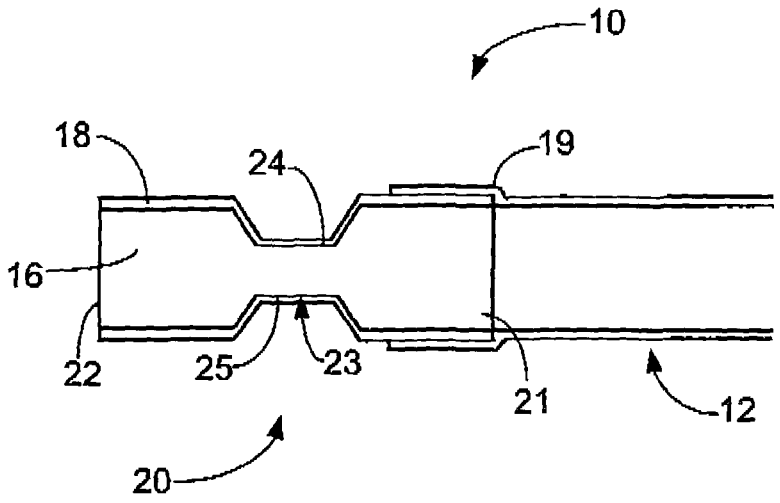

contoured portion defines an exterior surface of the smoking article and having a first cross-sectional area that is less than a cross-sectional area of either the cylindrical rod end portion or the cylindrical mouth end portion.

14 Claims, 1 Drawing Sheet

(56) References Cited

U.S. PATENT DOCUMENTS

| | | | | |
|---|---|---|---|---|
| 3,800,805 | A | 4/1974 | Horsewell et al. | |
| 3,894,544 | A | 7/1975 | Egri | |
| 4,423,744 | A | 1/1984 | Berger | |
| 4,601,298 | A | 7/1986 | Nichols et al. | |
| 5,058,608 | A * | 10/1991 | Henning | A24D 3/043 131/336 |
| 5,396,909 | A * | 3/1995 | Gentry | A24D 3/04 131/332 |
| 5,724,998 | A | 3/1998 | Gellatly et al. | |
| 6,182,669 | B1 | 2/2001 | van der Elst | |
| 2002/0153017 | A1 | 10/2002 | Georgitsis et al. | |
| 2011/0120481 | A1 * | 5/2011 | Besso | A24D 3/0212 131/275 |

FOREIGN PATENT DOCUMENTS

| | | | |
|---|---|---|---|
| FR | 1 127 550 | A | 12/1956 |
| GB | 983928 | | 2/1965 |
| JP | 11-507242 | A | 6/1999 |
| JP | H11276147 | A | 10/1999 |
| JP | 2002-335937 | A | 11/2002 |
| JP | 2004033097 | A | 2/2004 |
| KR | 20090006207 | U | 6/2009 |
| WO | WO 2004/037025 | A2 | 5/2004 |
| WO | WO 2009/077244 | A1 | 6/2009 |
| WO | WO 2010/063591 | A1 | 6/2010 |

OTHER PUBLICATIONS

International Search Report and Written Opinion for PCT/IB2013/058647, issued by the European Patent Office dated Feb. 13, 2014; 10 pgs.

Fourth Chinese Office Action issued for CN Application No. 201380050516.0 dated Sep. 26, 2019; issued by the Chinese Patent Office; including English Translation; 16 pgs.

Japanese Office Action issued for JP Application No. 2015-533730 dated May 27, 2019; issued by the Japanese Patent Office; including English Translation; 11 pgs.

* cited by examiner

SMOKING ARTICLE WITH CONTOURED FILTER PORTION

This application is the § 371 U.S. National Stage of International Application No. PCT/IB2013/058647, filed 18 Sep. 2013, which claims the benefit of U.S. Provisional Application No. 61/706,943, filed 28 Sep. 2012 and European Application No. 12186560.4, filed 28 Sep. 2012, each of which are incorporated by reference herein in their entireties.

The present disclosure relates to a smoking articles having a contoured filter portion, for example to mate with fingers of a user.

Combustible smoking articles, such as cigarettes, have shredded tobacco surrounded by a paper wrapper forming a tobacco rod. A cigarette is employed by a smoker by lighting one end thereof and burning the shredded tobacco rod. The smoker then receives mainstream smoke into their mouth by drawing on the opposite end or filter end of the cigarette. The shredded tobacco can be a single type of tobacco or a blend of two or more types of tobacco depending of the brand of cigarette.

A number of smoking articles in which an aerosol generating substrate, such as tobacco, is heated rather than combusted have also been proposed in the art. In heated smoking articles, the aerosol is generated by heating the aerosol generating substrate. Known heated smoking articles include, for example, smoking articles in which an aerosol is generated by electrical heating or by the transfer of heat from a combustible fuel element or heat source to an aerosol generating substrate. During smoking, volatile compounds are released from the aerosol generating substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

These smoking articles usually have a cylindrical shape. This cylindrical shape can be difficult or uncomfortable to hold by a user in some instances. The smooth cylinderical shape can also slip from a users grasp.

It would be desirable to provide a smoking article that is easily held by a user. It is desirable to provide a smoking article that has an ergonomic filter portion shape while retaining a cylindrical shaped mouth end portion.

According to the current disclosure there is provided a smoking article that includes a contoured filter element having a cylindrical rod end portion and a cylindrical mouth end portion and a contoured portion between the cylindrical rod end portion and a cylindrical mouth end portion. The contoured portion defines an exterior surface of the smoking article and has a first cross-sectional area that is less than a cross-sectional area of either the cylindrical rod end portion or the cylindrical mouth end portion. The contoured filter element is configured to mate with fingers of a user of the smoking article.

The smoking article with contoured filter portion and the methods according to the present disclosure provide an effective way to improve the comfort level of a user while employing the smoking article along with the ability to securely grasp the smoking article. In addition, the smoking article with contoured filter portion can be readily manufactured according to the methods described herein.

The term "smoking article" as used herein includes cigarettes, cigars, cigarillos and other articles in which a smoking composition, such as a tobacco composition, is lit and combusted to produce smoke. The term "smoking article" also includes those in which the smoking composition is not combusted, such as but not limited to smoking articles that heat the smoking composition directly or indirectly, or smoking articles that use air flow or a chemical reaction to deliver nicotine, flavour compound or other materials from the tobacco, without combustion, and in some cases without heating.

As used herein, the term "smoke" is used to describe an aerosol produced by a smoking article. An aerosol produced by a smoking article may be, for example, smoke produced by combustible smoking articles, such as cigarettes, or aerosols produced by non-combustible smoking articles, such as heated smoking articles or non-heated smoking articles.

The term "tobacco" includes tobacco leaf, tobacco manufacturing by-products such as tobacco stems and tobacco dust, and mixtures thereof.

"Reconstituted tobacco" refers to a tobacco substrate that has been formed from tobacco by-products such as tobacco dust and tobacco fragments from tobacco processing or handling, for example. This tobacco dust created by tobacco breakage during shipping and manufacturing, leaf lamina, stems and other tobacco by-products that are finely ground may be mixed with a binder to agglomerate the particulate tobacco. The agglomerated tobacco may include other additives, including but not limited to, aerosol-formers (such as glycerine or propylene glycol), plasticizers, humectants, and non-tobacco fibers, fillers, aqueous and non-aqueous solvents and combinations thereof. The agglomerated tobacco can be cast, extruded, or rolled. A number of reconstitution processes for producing homogenized tobacco materials are known. These include, but are not limited to: paper-making processes of the type described in, for example, U.S. Pat. No. 5,724,998; casting processes of the type described in, for example, U.S. Pat. No. 5,724,998; dough reconstitution processes of the type described in, for example, U.S. Pat. No. 3,894,544; and extrusion processes of the type described in, for example, in GB 983,928.

The term "contoured" refers to a portion that defines an exterior shape that has at least two different cross-sectional dimensions.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

Smoking articles according to the present disclosure include a contoured filter element. The contoured filter element can be configured to mate with fingers of a user. In many embodiments, the contoured filter element has a cylindrical rod end portion and a cylindrical mouth end portion and a contoured portion between the cylindrical rod end portion and a cylindrical mouth end portion. The contoured portion defines an exterior surface of the finished smoking article. The exterior surface of the finished smoking article may be contoured to match the contour of the contoured filter element. The contoured portion, and the corresponding exterior surface of the finished smoking article, has a first cross-sectional area that is less than a cross-sectional area of either the cylindrical rod end portion or the cylindrical mouth end portion. At least one cross-section of the contoured portion is different than a cross-section of either the cylindrical rod end portion or the cylindrical mouth end portion.

The exterior surface of the contoured portion, and the corresponding exterior surface of the finished smoking article, can define any useful surface that is reduced from the cylindrical rod end portion or the cylindrical mouth end portion cylindrical surfaces. In many embodiments the cylindrical rod end portion or the cylindrical mouth end portion have the same or similar diameters. The exterior surface of the contoured portion can define a surface that is less than the diameter of either the cylindrical rod end portion or the cylindrical mouth end portion. The exterior surface of the contoured portion can define a segment of a cylinder or a horizontal cylinder segment. A segment of a cylinder or a horizontal cylinder segment refers to the remaining portion of a cylinder body that is less than a regular cylinder body. The segment of a cylinder or a horizontal cylinder segment can define one or more planar surfaces or one or more curvilinear surfaces. The diameter of the cylindrical mouth end portion and the cylindrical rod end portion can be about 7 mm or in a range from about 4 mm to about 9 mm.

The contoured filter element can have any useful longitudinal length. In many embodiments, the contour features begin at a location at least about 5 mm, or at least about 8 mm, or at least about 10 mm, or from about 5 mm to about 15 mm, from a mouth end of the smoking article or from the mouth end of the contoured filter element. In some embodiments, the contour features begin at a location at least about 5 mm, or at least about 8 mm, or at least about 10 mm, or from about 5 mm to about 15 mm, from an upstream end of the filter or from an upstream end of the contoured filter element. The contour features can have a longitudinal length of at least about 5 mm or at least about 8 mm or at least about 10 mm or in a range from about 5 mm to about 30 mm or in a range from about 8 mm to about 20 mm.

In many embodiments the exterior surface of the contoured portion, and the corresponding exterior surface of the finished smoking article, defines at least one or a plurality of planar surfaces. In one embodiment the exterior surface of the contoured portion defines opposing planar surfaces and forms a segment of a cylinder or a horizontal cylinder segment. In one embodiment the exterior surface of the contoured portion defines a single planar surface and forms a segment of a cylinder or a horizontal cylinder segment. The one or more planar surfaces can extend along a longitudinal cross-section of the contoured filter element.

In many embodiments the exterior surface of the contoured portion, and the corresponding exterior surface of the finished smoking article, defines at least one or a plurality of curvilinear surfaces. In one embodiment the exterior surface of the contoured portion defines a continuous curvilinear surface and a longitudinal cross-secction forms an hourglass shape. In one embodiment the exterior surface of the contoured portion defines a single curvilinear surface and forms a segment of a cylinder or a horizontal cylinder segment. In another embodiment the the exterior surface of the contoured portion defines opposing curvilinear surfaces and forms a segment of a cylinder or a horizontal cylinder segment. The one or more curvilinear surfaces can extend along a longitudinal cross-section of the contoured filter element.

The contoured filter element can be formed with one or more segments. For example the contoured filter element can be formed of a plurality of segments. In one embodiment, the contoured filter element includes a contoured filter segment separating a mouth end segment and a rod end segment. The contoured filter segment, mouth end segment and a rod end segment can be abutted together in axial alignment to form the contoured filter element. Plug wrap can be disposed about at least a portion of the contoured filter segment, mouth end segment and a rod end segment to fix the three segments together in axial alignment.

The plug wrap can be any useful material that can wrap around and conform closely at least a portion of the contoured filter segment, mouth end segment and a rod end segment and conform to form the contoured exterior surface that mimicks the contours of the contoured filter element. In many embodiments, the plug wrap can be formed of a polymeric film such as a shrink wrap film. The polymeric or shrink wrap film can be disposed about at least a portion of the contoured filter segment, mouth end segment and a rod end segment and heated, for example, to conform to the contoured surface or surface topography of the contoured filter element and form the corresponding contoured exterior surface of the finished smoking article.

In some of these embodiments the mouth end segment and a rod end segment have a cylindrical shape and a diameter that is substantially equal and the contoured filter segment has a mouth end and a rod end that have a cylindrical shape and a diameter that is substantially equal to the cylindrical shape and a diameter of the mouth end segment and a rod end segment. The diameter of the mouth end segment and a rod end segment can be about 7 mm or in a range from about 4 mm to about 9 mm. The cylindrical end portions of the contoured filter segment can mate with the cylindrical portion of abutting mouth end and a rod end segments, allowing the plug wrap to fix the contoured filter segment, mouth end segment and a rod end segments in axial alignment.

When present, the longitudinal length of the mouth end segment or rod end segment can be at least about 5 mm or at least about 8 mm or at least about 10 mm or in a range from about 5 mm to about 15 mm or in a range from about 8 mm to about 12 mm. When present, the longitudinal length of the contoured filter segment is at least about 8 mm or at least about 10 mm or at least about 15 mm or in a range from about 8 mm to about 30 mm or in a range from about 10 mm to about 20 mm. The contour features can have a longitudinal length of at least about 5 mm or at least about 8 mm or at least about 10 mm or in a range from about 5 mm to about 30 mm or in a range from about 8 mm to about 20 mm.

The contoured filter element or contoured portion has a predetermined shape or form. The contoured filter element or contoured portion can be formed of any useful rigid or pre-formed material such as, polymer, paperboard, or reconstituted tobacco. In contrast to common filter material or elements, which are rather soft and can easily be cut or compressed, the contoured filter element or contoured portion is rather solid or rigid material and has a predetermined shape. In many embodiments, the contoured filter element or contoured portion is hollow and has a resistance to draw (RTD) of less than about 50 mm $H_2O$ or less than about 30 mm $H_2O$ when the contoured filter element or contoured portion is tested. The contoured filter element or contoured portion may have a RTD of more than about 5 mm $H_2O$. The RTD of the contoured filter element or contoured portion can also be expressed in RTD per mm of contoured filter element or contoured portion and can be less than about 5 mm $H_2O$ per mm of contoured filter element or contoured portion or less than about 2 mm $H_2O$ per mm of contoured filter element or contoured portion. The contoured filter element or contoured portion may have an RTD of greater than 1 mm $H_2O$ per mm of contoured filter element or contoured portion.

The contoured filter element cylindrical rod end portion and a cylindrical mouth end portion can include any useful filtering material. If present, the mouth end segment and rod end segment can include any useful filtering material. Useful filtering material includes standard cellulose acetate tow, paper or more generally cellulose sorbent material, other known polymeric fibers, or the like.

In many embodiments, the contoured filter element can be axially aligned with and fixed to a tobacco rod or aerosol generating substrate with tipping paper. Tipping paper can extend about at least a portion of the contoured filter element and the tobacco rod or aerosol generating substrate. In some embodiments, the tipping paper is disposed about the mouth end portion or segment and rod end portion or segment of the contoured filter element. In some of these embodiments, the tipping paper is not disposed about the contoured features of the contoured filter element. The tipping paper can be formed of conventional tipping paper material or the tipping paper can be formed of a polymeric film such as a shrink wrap film, similar to the pug wrap described above. In some embodiments, the tipping paper is a shrink wrap film and is disposed about the contoured features of the contoured filter element and conforms to the external surface topography of the contoured features.

Figure 2:
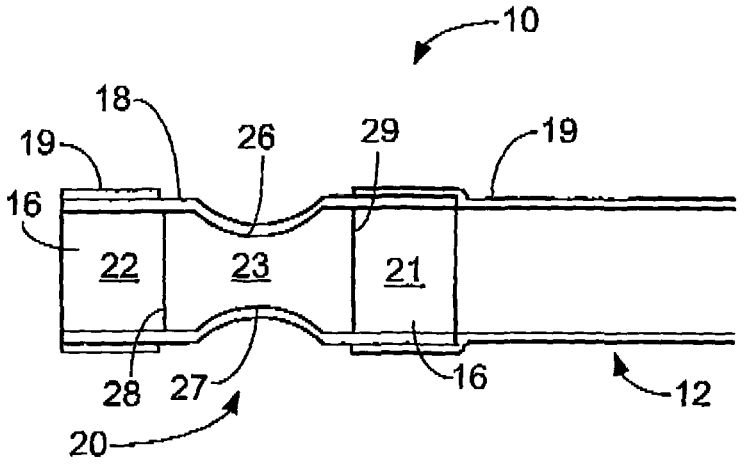

The disclosure will be further described, by way of example only, with reference to the accompanying drawings, in which:

FIG. 1 shows a schematic cross section view of a smoking article according to the present disclosure having a contoured filter element; and FIG. 2 shows a schematic cross section view of a smoking article according to the present disclosure having a three segment contoured filter element.

The finished smoking article 10 shown in FIG. 1 includes a tobacco substrate or tobacco rod 12 (or aerosol generating substrate) attached to an axially aligned contoured filter element 20. The contoured filter element 20 includes a filter material 16 that can include cellulose acetate wrapped in plug wrap 18. Tipping paper 19 joins the tobacco rod 12 (or aerosol generating substrate) to the axially aligned contoured filter element 20

The contoured filter element 20 has a cylindrical rod end portion 21 and a cylindrical mouth end portion 22 and a contoured portion 23 between the cylindrical rod end portion 21 and a cylindrical mouth end portion 22. The contoured portion 23 illustrated in FIG. 1 includes opposing planar surfaces 24, 25 along a longitudinal cross-section of the contoured filter element 20 and forming a segment of a cylinder or a horizontal cylinder segment. Plug wrap 18 is in contact with and is disposed about the contoured filter element 20 and conforms to the exterior surface of the contoured portion 23.

The finished smoking article 10 shown in FIG. 2 includes a tobacco substrate or tobacco rod 12 attached to an axially aligned contoured filter element 20 with tipping paper 19. The contoured filter element 20 includes three segments. A contoured filter segment 23 separates a mouth end segment 22 and a rod end segment 21.

The contoured filter segment 23, mouth end segment 22 and a rod end segment 21 can be abutted together in axial alignment to form the contoured filter element 20. The contoured filter segment 23 illustrated includes opposing ends 28 and 29 that are cylindrical and register with the adjacent ends of the mouth end segment 22 and a rod end segment 21.

Plug wrap 18 can be disposed about at least a portion of the contoured filter segment 23, mouth end segment 22 and a rod end segment 21 to fix the three segments together. The plug wrap 18 is in contact with and is disposed about the contoured filter element 20 and conforms to the exterior surface of the contoured segment 23 and at least a portion of the mouth end segment 22 and a rod end segment 21.

The contoured segment 23 illustrated in FIG. 2 includes opposing curviliner surfaces 26, 27 along a longitudinal cross-section of the contoured filter element 20 and forming a segment of a cylinder or a horizontal cylinder segment. The opposing curviliner surfaces 26, 27 along a longitudinal cross-section can be symmetrical about a central longitudinal axis of the contoured filter segment 23 forming an hourglass shape.

The mouth end segment and a rod end segment can include a filter material 16 that can include cellulose acetate wrapped in plug wrap 18. Tipping paper 19 joins the tobacco rod 12 to the axially aligned contoured filter element 14. The tipping paper 19 is illustrated being disposed on top of the plug wrap 18 and about the mouth end segment 22 and a rod end segment 21 and not disposed about the contoured segment 23.

The invention claimed is:

1. A smoking article comprising:

a contoured filter element having a cylindrical rod end portion and a cylindrical mouth end portion and a contoured portion with a predetermined shape or form imposed between the cylindrical rod end portion and the cylindrical mouth end portion, the contoured portion having a first cross-sectional area that is less than a cross-sectional area of either the cylindrical rod end portion or the cylindrical mouth end portion, an exterior surface in the area of the contoured filter, wherein the exterior surface has a contour defined by the contoured portion, and the contour of the exterior surface of the smoking article is configured to mate via direct contact with fingers of a user of the smoking article; and a plug wrap in contact with and disposed about the contoured filter segment, wherein the plug wrap is a polymeric shrink wrap film which conforms to the contoured portion and forms the contoured exterior surface of the smoking article.

2. A smoking article according to claim 1, wherein the exterior surface of the smoking article is contoured to match the contour of the contoured filter element.

3. A smoking article according to claim 1, wherein the contoured filter element exterior surface defines a planar surface along the contoured filter element.

4. A smoking article according to claim 1, wherein the contoured filter element exterior surface defines opposing planar surfaces along the contoured filter element.

5. A smoking article according to claim 1, wherein the contoured filter element exterior surface defines a curvilinear surface along a longitudinal cross-section of the contoured filter element.

6. A smoking article according to claim 5, wherein the curvilinear surface or curvilinear surfaces define an hourglass shape along a longitudinal cross-section of the contoured filter element.

7. A smoking article according to claim 1, wherein the contoured filter element exterior surface defines opposing curvilinear surfaces along a longitudinal cross-section of the contoured filter element.

8. A smoking article according to claim 1, wherein the plug wrap fixes the contoured filter segment, mouth end segment and a rod end segment together in axial alignment.

9. A smoking article according to claim 1, wherein the contoured filter element comprises opposing cylindrical ends.

10. A smoking article according to claim 1, wherein the contoured filter portion is hollow.

11. A method of forming a smoking article comprising, forming a smoking article having a contoured filter element having a cylindrical rod end portion and a cylindrical mouth end portion and a contoured portion with a predetermined shape or form imposed between the cylindrical rod end portion and the cylindrical mouth end portion, the contoured portion having a first cross-sectional area that is less than a cross-sectional area of either the cylindrical rod end portion or the cylindrical mouth end portion;

disposing a shrink wrap film about the contoured filter element; and heating the shrink wrap film to conform the shrink wrap film about the contoured filter element;

wherein an exterior surface of the smoking article has a contour defined by the contoured portion, and the contour of the exterior surface of the smoking article is configured to mate via direct contact with fingers of a user of the smoking article.

12. A method according to claim 11 wherein the forming step comprises aligning a contoured filter segment between a mouth end segment and rod end segment to from the contoured filter element and fixing the contoured filter segment, mouth end segment and a rod end segment together with the shrink wrap film.

13. A method according to claim 11 wherein the contoured filter element exterior surface defines opposing curvilinear surfaces along a longitudinal cross-section of the contoured filter element.

14. A method according to claim 13 wherein the curvilinear surface or curvilinear surfaces define an hourglass shape along a longitudinal cross-section of the contoured filter element.

* * * * *